United States Patent [19]

Geri et al.

[11] Patent Number: 4,482,333

[45] Date of Patent: Nov. 13, 1984

[54] AUTOMATIC INFLATION SYSTEM

[75] Inventors: Don W. Geri, Moss Beach; Roy E. Hurtig, Saratoga, both of Calif.

[73] Assignee: Geri Engineering, Inc., San Carlos, Calif.

[21] Appl. No.: 373,653

[22] Filed: Apr. 30, 1982

[51] Int. Cl.[3] ..... B63B 21/52

[52] U.S. Cl. ..... 441/30; 441/93; 343/709; 340/539; 340/687

[58] Field of Search ..... 441/7, 9, 11, 12, 13, 441/20, 23, 24, 25, 26, 27, 30, 36, 92, 93, 94, 96, 99; 114/329, 336, 367; 343/709, 710; 200/61.08; 240/568, 539, 687, 652

[56] References Cited

U.S. PATENT DOCUMENTS

| | | | |
|---|---|---|---|
| 1,173,482 | 2/1916 | Carlson | 441/96 |
| 2,722,342 | 11/1955 | Fox | 222/5 |
| 2,758,203 | 8/1956 | Harris | 343/709 |
| 2,825,803 | 3/1958 | Newbrough | 441/11 |
| 2,903,718 | 9/1959 | Wright | 441/30 |
| 2,907,875 | 10/1959 | Seyfang | 343/709 |
| 2,919,833 | 1/1960 | Wolshin | 222/5 |
| 3,077,288 | 2/1963 | Henry | 222/5 |
| 3,121,239 | 2/1964 | Cannon, Jr. | 441/24 |
| 3,132,626 | 5/1964 | Reid | 441/23 |
| 3,147,499 | 9/1964 | Nelson et al. | 441/93 |
| 3,266,669 | 8/1966 | Vuyosevich | 222/5 |
| 3,312,902 | 4/1967 | Dean et al. | 343/709 |
| 3,335,371 | 8/1967 | Yandell | 200/61.08 |
| 3,397,413 | 8/1968 | Houtsma | 441/20 |
| 3,444,547 | 5/1969 | Surek | 340/568 |
| 3,449,777 | 6/1969 | Hattori | 9/316 |
| 3,487,810 | 1/1970 | Clement | 441/23 |
| 3,490,648 | 1/1970 | Fujimoto | 222/5 |
| 3,547,165 | 12/1970 | Butterworth | 141/330 |
| 3,597,780 | 8/1971 | Coyle | 222/5 |
| 3,610,470 | 10/1971 | Waters | 222/5 |
| 3,898,641 | 8/1975 | Banner | 340/568 |
| 3,997,079 | 12/1976 | Niemann | 222/5 |
| 4,033,002 | 7/1977 | Higgs | 441/26 |
| 4,053,896 | 11/1967 | Bitter et al. | 343/709 |
| 4,063,323 | 12/1977 | Salvarezza | 9/14 |
| 4,161,797 | 7/1979 | Ruscigno | 9/316 |
| 4,223,805 | 9/1980 | Mackal | 222/5 |
| 4,224,707 | 9/1980 | Mariani | 441/11 |
| 4,232,417 | 11/1980 | Miller et al. | 441/93 |

FOREIGN PATENT DOCUMENTS

| | | | |
|---|---|---|---|
| 2223847 | 11/1974 | France | 343/709 |
| 1198867 | 7/1970 | United Kingdom | 441/94 |

*Primary Examiner*—Trygve M. Blix
*Assistant Examiner*—Thomas J. Brahan
*Attorney, Agent, or Firm*—Thomas E. Schatzel

[57] ABSTRACT

An automatic inflation system for use as an emergency locating system which is activated by the severance of an initiator wire which in turn begins the operation of a transmitter and a timer. Following a period of time as determined by the timer, a pair of electrically activated pyrotechnic thrusters are actuated and cause the rupture of seals on a pair of compressed gas storage cylinders which in turn results in the inflation of two sections of a twin mast, raising a radio antenna and radar reflective material. A radio transmitter is also activated at the start of the time delay with an emergency locating signal broadcast from the antenna, after the mast is raised. This system provides improved means of locating missing equipment when searched for by radio search, radar search, and/or visual search.

5 Claims, 8 Drawing Figures

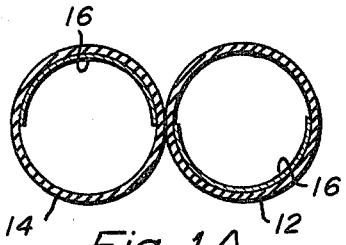
Fig_1A
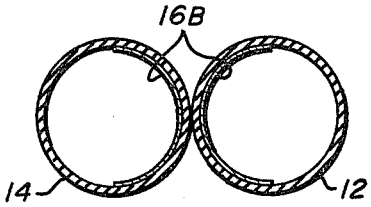
Fig_1B
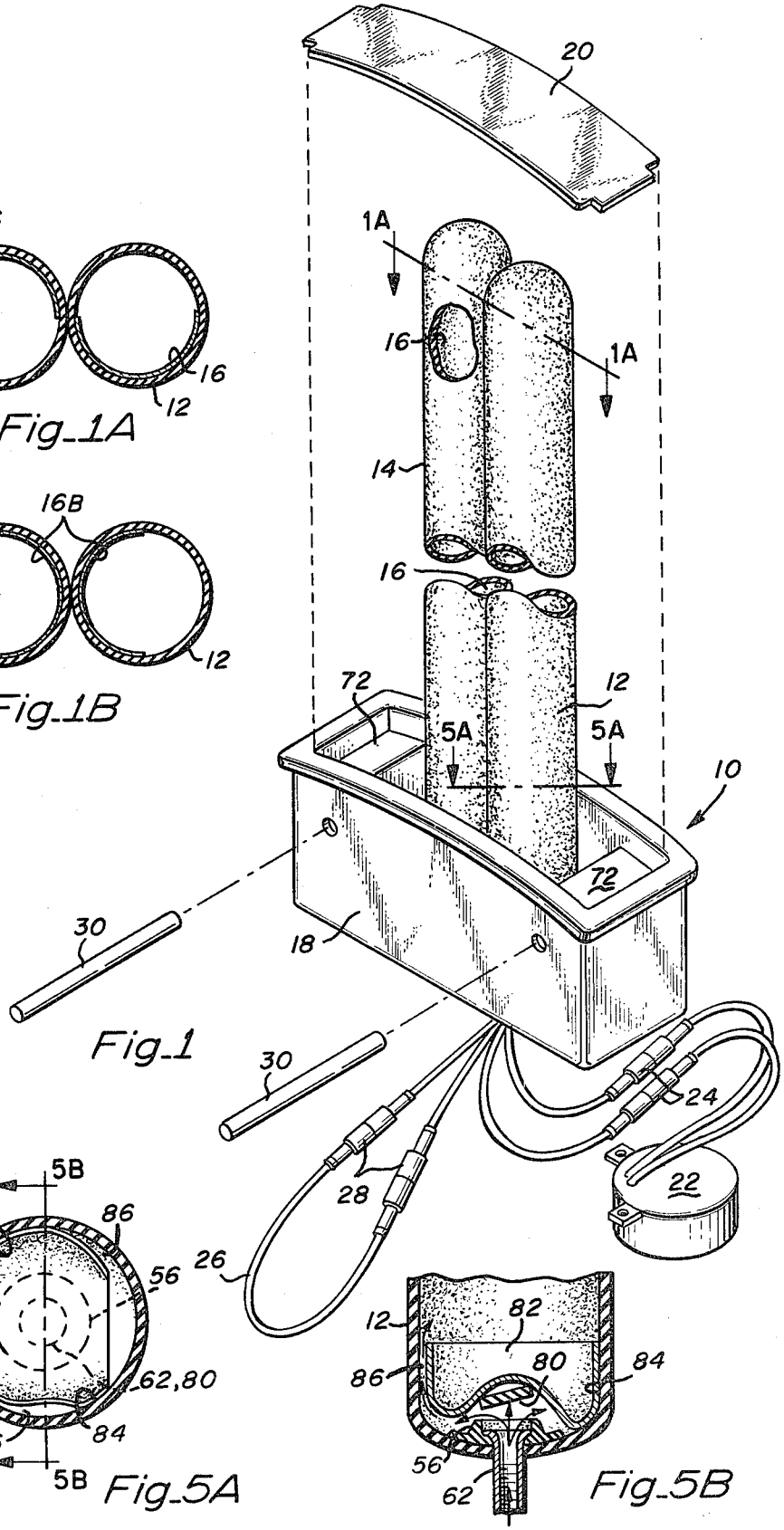
Fig_1
Fig_5A
Fig_5B

AUTOMATIC INFLATION SYSTEM

BACKGROUND OF THE INVENTION

1. Field of the Invention

The invention relates generally to inflation systems wherein a stored chamber of compressed gas is used to inflate an inflatable device in automatic response to some occurrence. More particularly, the invention relates to such an automatic inflation system operable in and around water, such as flotation systems and emergency locating systems, and also with devices utilizing lighter than air gases to automatically inflate balloons which will rise in the atmosphere.

2. Description of the Prior Art

Automatic inflators are well known in the fields of life-saving and signalling equipment. Among such prior disclosed automatic inflators are the following: U.S. Pat. No. 4,223,805 granted to Mackal; U.S. Pat. No. 3,997,079 granted to Niemann; U.S. Pat. No. 3,266,669 granted to Vuyosevich; U.S. Pat. No. 3,490,648 granted to Fujimoto; U.S. Pat. No. 2,722,342 granted to Fox; U.S. Pat. No. 3,610,470 granted to Waters; U.S. Pat. No. 3,597,780 granted to Coyle; U.S. Pat. No. 3,449,777 granted to Hattori; U.S. Pat. No. 2,919,833 granted to Wolshin; and U.S. Pat. No. 3,077,288 granted to Henry. All of these patents disclose devices, however, which are designed in a manner such as to have their automatic operation be responsive to submersion in water through the use of various systems such as dissolution of a water soluable tablet, weakening and resulting rupture of a paper band following wetting, energization of a battery by allowing water into the battery to become the electrolyte, or by the increasing of the conductivity between electrodes which results from immersion of the electrodes in water. As such, all of these devices are unsuitable for applications where immersion in water is a normal condition and cannot be the occurrence which initiates the automatic inflation. These devices are also unsuited to situations where immersion in water is never the case, and not the desired condition for which an automatic response is desired.

Automatic signalling and locating devices have long been known. U.S. Pat. No. 4,063,323 granted to Salvarezza discloses an automatically separating system which inflates a flotation device and which automatically emits smoke and operates a flashing beacon. Such a device provides aids for visual search as well as a radio signal or a radar beam to assist in locating the device. It does not, however, provide for elevation of the signalling devices by inflatable masts.

Various applications of detonation devices for puncturing the seal on compressed gas containers have been disclosed by the prior art. In U.S. Pat. No. 4,161,797 granted to Ruscigno as well as the patents issued to Vuyosevich, Coyle, Hattori, and Henry all referred to above, have all described such applications of detonating devices. Similarly, numerous designs are available for providing for passage of the compressed gas past the puncture pin in a seal rupturing system. The Fujimoto '648 patent, discusses various pin designs which allow the gas to exit the compressed gas container following puncture of the seal without the need for removing the pin. Removing the pin is an alternative approach which can be accomplished either by the method disclosed by the Wolshin '833 patent or by the method described in U.S. Pat. No. 3,547,165 granted to Butterworth.

The length of time required between the occurrence intended to cause the automatic response and such automatic response has been addressed by the Vuyosevich '669 patent, from the standpoint of shortening such time period. Nowhere, however, has the prior art recognized that there could be circumstances where such time period might need to be intentionally lengthened.

A particular need exists for an emergency locating device for underwater remote controlled vehicles which become lost. Underwater remote controlled vehicles occasionally get their operating tether cable tangled which makes it impossible to retrieve the vehicle. Remote control of severance of the tether cable at the vehicle allows said vehicle to rise to the surface and drift after it has been severed from the tether cable. An emergency locating system for such a vehicle could not be water activated, but needs activation by some means related to the vehicle being cut loose. At the same time, it is not appropriate for such an emergency locating system to activate until the vehicle has had time to float to the surface.

SUMMARY OF THE INVENTION

It is therefor an object of this invention to provide an automatic inflation system which is compatible with underwater application.

It is a further object of this invention to provide an inflation system which can be arranged so as to respond automatically when a cable is cut.

It is a further object of this invention to provide a multi-method locating system to assist in the locating of unmanned equipment when its location has become unknown.

It is a further object of this invention to provide an emergency locating system which will inflate its inflatable portion only after a time delay following the occurrence of the initiating event, thus allowing an underwater vehicle to rise to the surface before the inflation occurs.

Briefly, a preferred embodiment of the present invention includes an automatic emergency locating system which, has an initiator wire which, when severed, initiates the timing of a time delay, followed by the opening of stored containers of compressed gas which in turn inflate two sections of a twin mast, raising a radio antenna radar reflective material. A radio transmitter is also energized at the start of the time delay with a locating signal broadcast through the antenna after the mast is raised. The system therefor provides for radio, radar and visual locating of the device.

An application of the preferred embodiment is an emergency locating system for underwater remote-controlled vehicles. Such underwater remote-controlled vehicles are normally used as carriers for underwater cameras, and they are connected back to a ship by a deployment cable and a tether cable. The length of the deployment cable may be as much as 2,000 feet and the tether cable may be as much as 400 feet; hence, the vehicle can be used for remote observation over a considerable range. Should the tether/control cable become tangled in a manner such that the vehicle cannot be recovered by drawing in the tether cable, a signal is sent activating a device within the vehicle which severs the tether/control cable at the vehicle. Although the vehicle is buoyant, it may take a significant amount of time before it rises to the surface, and locating it can be difficult.

In a preferred embodiment of the inflation system of the present invention, it is attached to the underwater vehicle and connected in such a manner as to have its initiator wire located in close proximity to the tether cable such that when the tether cable is severed, the initiator wire is also severed. A timer provides a time delay during which the vehicle can rise to the surface. After the vehicle rises to the surface and elapse of the time delay, the masts are inflated raising the radio antenna thus allowing radio transmission.

An advantage of this invention is that the initiator wire is immune to the presence or absence of water. Hence, the invention is applicable in applications where the system must be underwater without necessarily operating, and could also be applied in systems which never come into contact with water, but must operate automatically in response to some other occurrence.

A further advantage of the present invention is that it can be applied in a manner to allow its operation to be initiated by the severance of a cable by locating the initiator wire in close proximity to the cable, thus allowing the device to be activated by the severance of the tether cable of an underwater romote vehicle.

A further advantage of the present invention is that various methods of locating the lost device are provided for, e.g. a radio signal, a radar reflective locating mast, and improved visibility.

A further advantage is that a built-in time delay allows an underwater vehicle to rise to the surface after the tether cable is cut and before the emergency locating system inflates its masts.

These and other objects and advantages of the present invention will no doubt become obvious to those of ordinary skill in the art after having read the following detailed description of the preferred embodiment which is illustrated in the various drawing figures.

IN THE DRAWING

FIG. 1 is a perspective view of an automatic inflation system of the present invention, in a configuration wherein it is utilized as an emergency locating system and shown in the fully inflated condition;

FIG. 1A is a top cross sectional view of the mast sections taken along the line 1A—1A of FIG. 1 and showing the position of the radar reflective material;

FIG. 1B is a top cross sectional view of the mast section taken along the same line as in FIG. 1A but showing an alternate postion of the radar reflective material;

FIG. 5A is a top sectional view along the line 5A—5A of FIG. 1; and

FIG. 5B is a cross-sectional view along the line 5B—5B of FIG. 5A.

DETAILED DESCRIPTION OF THE PREFERRED EMBODIMENT

Figure 2:
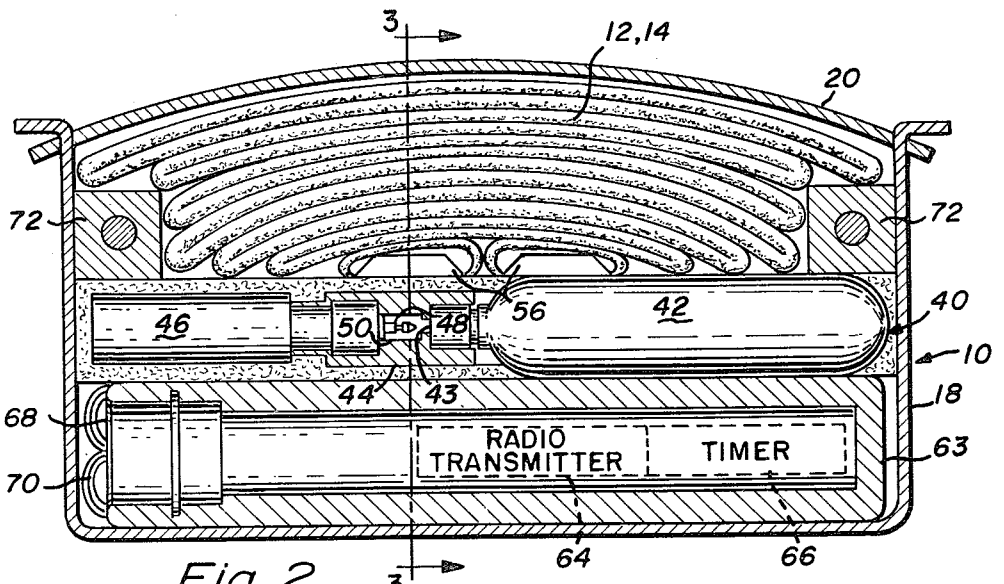
FIG. 2 is a front elevational cross section view of the automatic inflation system taken along the line 2—2 of FIG. 3 with the inflatable mast shown in the deflated and folded condition.

FIGS. 1, 1A and 2, illustrate an automatic inflation system in a configuration for use as an automatic emergency locating system, referred to by the general reference number 10 and incorporating the present invention. The system 10 includes an inflatable radio transmitter antenna mast with dual sections 12 and 14. Both mast sections 12 and 14 are shown in the fully inflated condition in FIG. 1 and in the deflated condition in FIG. 2. Each of the radar reflective mast sections 12 and 14 contain a coating of a radar reflective material 16 which is on one-half of the inside surface of each mast section near the top. FIG. 1A is a cross-sectional view along the line 1A—1A illustrating the reflective materials 16 as each comprising a semi-circular arc oriented 180° relative to one another. FIG. 1B is a similar view of an alternative embodiment with the reflective materials designated 16B and shifted 90° relative to the position of materials 16 in FIG. 1A. An enveloping container 18, and a cover plate 20 are also associated with the system 10. The container 18 contains the mast sections 12 and 14 in the uninflated condition and the remaining portions of the system except for a battery 22 and an initiator wire 26. The battery 22 is connected with a pair of water-tight connectors 24 and the initiator wire 26 which is connected by a pair of water-tight connectors 28, all of which are located external to the enveloping container 18. Provision is made for attaching the system 10 to other equipment with a pair of installation pins 30 which are longer than the width of the enveloping container 18 so as to provide for affixation to other equipment, e.g. submersible unmanned objects.

Figure 3:
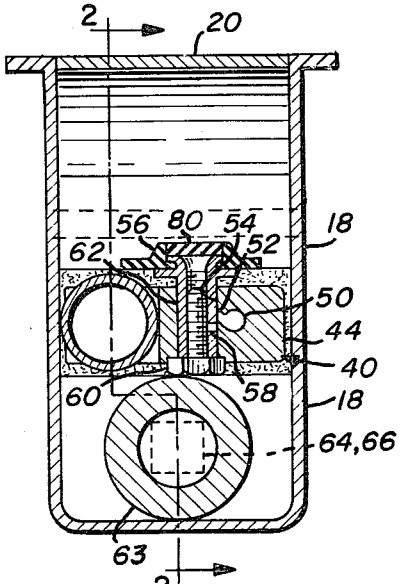
FIG. 3 is a side elevational cross section view of the automatic inflation system taken along line 3—3 of FIG. 2, but with the inflatable mast not included.
Figure 4:
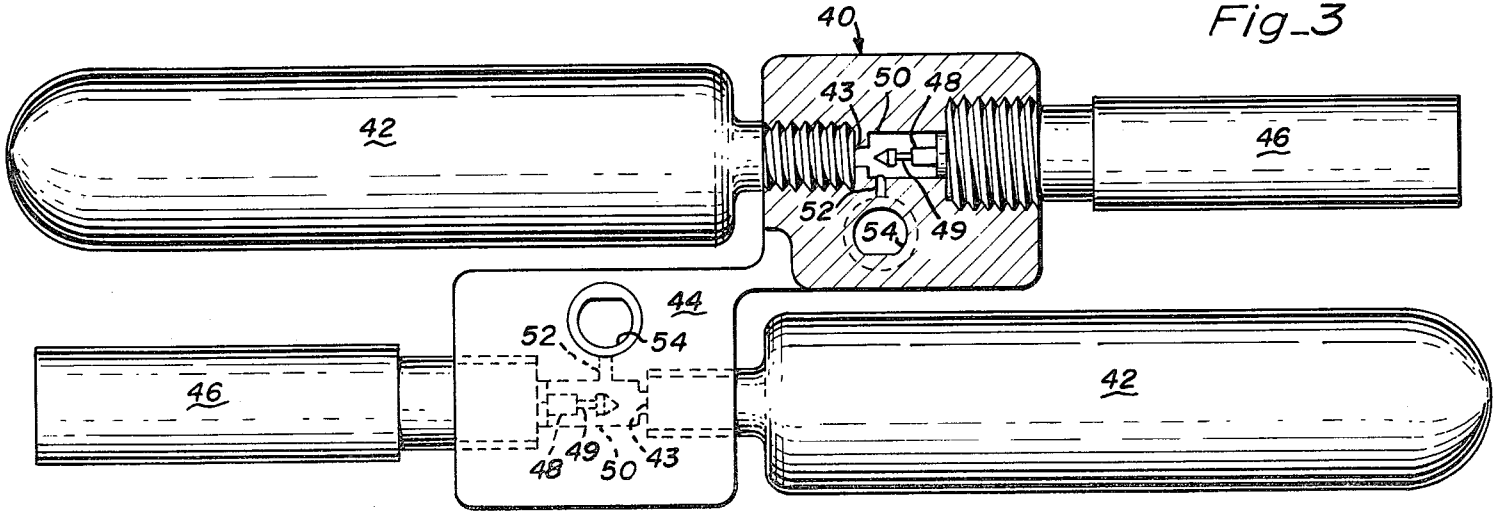
FIG. 4 is a top elevational view of the automatic inflation means of the automatic inflation system with an area in cross-section view to show the functional internal portion of said means.

Located inside the enveloping container 18 is an inflater assembly 40 which comprises the means of inflating the mast sections 12 and 14 and is shown in a front elevational cross section view in FIG. 2, in side elevational cross section view in FIG. 3, and in top elevational, partial cross section view in FIG. 4. The inflater assembly 40 includes a pair of compressed gas storage cylinders 42 fitted with end seals 43 and attached by threaded connection to an inflater assembly body 44, a pair of electrically actuated pyrotechnic thrusters 46 and a pair of piercing pins 48 with reduced pin diameter 49 having a differential cross sectional area of less than 0.0002 square inches to act as an orifice to control the flow of gas from the container to the mast sections 12 and 14, and slidably contained in a pair of cylindrical cavities 50. The piercing pins 48 are bonded by a suitable means to the ends of the electrically actuated pyrotechnic thrusters 46. The inflater assembly body is constructed so as to contain a pair of cylindrical holes 52 which provide connections from the cylindrical cavities 50 to a pair of reception cavities 54 with said reception cavities constructed so as to allow insertion of a pair of valve stem seats 56 and a pair of standard valve stems 62 similar to those normally used on pneumatic life vests and other inflatable devices with a clearance fit. The standard valve stems 62 are modified by the addition of a cross hole 58 in each, with the cross holes 58 providing a passageway from the clearance area between the valve stems 62 and reception cavities 54 to the inside of the valve stems 62. The valve stems 62 are fitted with a pair of cap nuts 60 in a manner such as to hold the valve stems 62 in place in the inflater assembly body 44 and also to seal the normal entrance to the valve stems 62 and thereby making cross holes 58 the only access for gas to the center of the valve stems 62. The valve stems 62 are fitted with a pair of one-way valves (not shown) similar to those normally used on pneumatic tires which prevent the mast sections 12 and 14 from deflating after inflation should any leak occur in the inflater assembly 40.

The system 10 also includes a water tight cylindrical container 63 which contains a radio transmitter 64 and a solid-state electronic timer 66 both of which are of designs using technology commonly known to those skilled in the art. A cap 68 seals the end of the water-tight cylindrical container 63 and provides for a water-tight seal to a group of wires 70 which connect to the transmitter 64 and timer 66 on the inside of the cylindrical container 63 and connect to the various other components on the outside of the cylindrical container 63. A pair of elastomeric blocks are bonded to the inflator assembly 40 and are located in the upper end areas of enveloping container 18 in the region through which the installation pins 30 are located.

FIGS. 5A and 5B illustrate a portion of the mast section 12. FIG. 5A is a view taken along the line 5A—5A of FIG. 1 and FIG. 5B is taken along the line 5B—5B of FIG. 5A. Each of the valve stem seats 56 have a circular disk cap 80 which is friction fit with the interior of the cavity in said valve stem seats 56 within the interior of the mast sections 12 and 14. A function of the cap 80 is to reduce friction between the end of the walls of the valve stem 62 and the mast material when the masts are deflated. For example, when the system 10 is submerged, the pressur acting on the system 10 causes the top 20 to press against the folded mast sections 12 and 14. This in turn causes the masts to compress against the structure of the valves stems 62. The friction may cause penetration of the mast material. To further overcome friction, there is a layer 82 of material similar to that of the mast sections 12 and 14. The layer 82 overlays the cap 80. The layer 82 is secured about part of its periphery to an interior of the mast section 12 by means of an adhesive or weld 84 so as to hold the layer in place over the end of the valve stem 62 and cap 80. The layer 82 is not secured around its entire periphery so as to provide for openings 86 between the layer 82 and the wall of the mast. The openings 86 in turn creates release paths for gas exiting through the valve stem 62 to the interior of the mast section 12. Depending on the pressure of the gas exiting through the stem 62 may cause the cap 80 to "pop" out or in the alternative the cap may have small openings to allow exit of the gas.

In operation, when the initiator wire 26 is interrupted by some means such as its severance, the timer 66 begins to time out a preset interval of time and energizes the radio transmitter 64. The timer 66 then energizes the electrically activated pyrotectic thrusters 46. The thrusters 46 propel the firing pins 48 slidably along the cylindrical cavities 50 in a manner such that the firing pins 48 puncture the end seals 43 on the compressed gas storage cylinders 42. Following puncture of the end seals 43 by firing pins 48, the compressed gas in the storage cylinders 42 travels through the small cylindrical opening created by the reduced pin diameters 49 in the firing pins 48, through the cylindrical cavities 50 through the cylindrical holes 52 and into the clearance between the reception cavities 54 and the valve stems 56. The gas then passes through the cross holes 58 to the inside of the valve stems 56 and up past the valves 62. The gas causes the cap 80 to "pop" loose thus gas then passes through the opening kbetween the layer 82 and into the mast sections 12 and 14. The gas then inflates the mast sections 12 and 14 causing the cover plate 20 to bulge outward until it pops free of the enveloping container 18, thus allowing the mast sections 12 and 14 to fully inflate. Valves (not shown) in valve stems 62 prevent the subsequent deflation of the mast sections 12 and 14 in the event that any of the aforementioned areas in the gas path are not completely sealed as they should be.

In the event of a failure of either section 12 or 14 to inflate either mast section 12 or 14 can cause the cover plate 20 to bulge outward until it pops free of the enveloping container 18. Either mast section now in the inflated condition, provides a raised antenna for the radio transmitter 64 thus allowing effective broadcast of an emergency locating signal. The radar reflective material 16 can be used directly as an antenna, or a separate antenna wire (not shown) may be provided on the inside of mast sections 12 and 14. At the same time, mast sections 12 and 14 provide targets which, due to the radar reflective coating 16 can be located by a radar search. Both mast sections 12 and 14 provide increased visibility which aids in visibly locating the vehicle.

The battery 22 provides the source of electric energy to power the timer 66 and the radio transmitter 64 as well as the energy used to fire the electrically actuated pyrotechnic thrusters 46. The system 10 is constructed in a manner such that the battery 22 and the initiator wire 26 can be easily replaced by separating their respective pairs of water-tight connectors 24 and 28. The inflater assembly 40 and the mast sections 12 and 14 can be replaced following operation of the system.

The intended application of the preferred embodiment of this invention is a locator for remote-controlled underwater vehicles. When such vehicles, which operate as a means of remote visual inspection through use of underwater cameras and typically have operating ranges in excess of 400 feet, at depths in the ocean of in the range of 2,000 feet, become unretrievable due to tether cable entanglement, the tether cable is normally remotely severed at the vehicle by remote control and the vehicle allowed to float freely to the surface. The preferred embodiment of this invention is connected to the underwater vehicle in such a manner that the initiator wire 26 is severed by the same action which severs the vehicle's tether cable. This initiates the operation of this embodiment as described above.

Although the present invention has been described in terms of the presently preferred embodiment, it is to be understood that such disclosure is not to be interpreted as limiting. Various alterations and modifications will no doubt become apparent to those skilled in the art after having read the above disclosure. Accordingly, it is intended that the appended claims be interpreted as covering all alterations and modifications as fall within the true spirit and scope of the invention.

We claim:

1. An automatic inflation system comprising, in combination;

an inflatable device comprising an inflatable radio-antenna mast with radar reflective material affixed to a portion of the surface thereof;

gas storage means for storing compressed gas;

an inflator means for opening the gas storage means and allowing the gas to transfer to the inflatable device;

a radio transmitter; and an electrically operable initiator means for activating the inflator means and the radio transmitter, the initiator means having an electric control circuit and an initiator wire, and being constructed to activate the inflator means and the radio transmitter in response to interruption of the electrical continuity of said initiator wire, said electric control circuit including a delay means for delaying for an interval of time the opening of the gas storage means and the activation of the radio transmitter following the interruption of said initiator wire;

whereby severance of said initiator wire results in inflation of said radio-antenna mast with radar reflective material, and activation of said radio transmitter, thus providing an aid in a search for the automatic inflation system.

2. The system of claim 1 wherein said radar reflective material comprises an arcuate shaped reflective layer coated on a portion of the interior of each of a plurality of parallel cylindrical mast sections of said inflatable radio-antenna mast with the arcuate shaped relfective layers being angularly disoriented relative to one another.

3. The system of claim 2 wherein, each layer is of arcuate shape of approximately one hundred and eighty degrees and each is displaced approximately one hundred and eightly degrees relative to the other.

4. An automatic inflation system comprising, in combination:

an inflatible device including an inflatible mast having a plurality of parallel cylindrically shaped mast sections, each of said mast sections having an arcuate shaped radar reflective layer coated on a portion of the interior cylindrical surface thereof, and each said arcuate shaped radar reflective layer forming an arc of approximately 180 degrees, each said arcuate shaped radar reflective layer being angularly displaced from each other arcuate shaped reflective layer;

a gas storage means for storing compressed gas;

an inflator means for opening the gas storage means and allowing the gas to transfer to the inflatible device; and an electrically operable initiator means for activating the inflator means, the initiator means having an electric control circuit and an initiator wire, and being constructed to activate the inflator means in response to interruption of the electrical continuity of said initiator wire.

5. An automatic inflation system comprising, in combination:

an inflatible device including an inflatible mast having two parallel cylindrical shaped mast sections, each of said mast sections having an arcuate shaped radar reflective layer coated on a portion of the interior cylindrical surface thereof, and each said arcuate shaped radar reflective layer forming an arc of approximately 180 degrees, said arcuate shaped reflective layers being displaced from each other by an angle of approximately 180 degrees;

a gas storage means for storing compressed gas;

an inflator means for opening the gas storage means and allowing the gas to transfer to the inflatible device; and an electrically operable initiator means for activating the inflator means, the initiator means having an electric control circuit and an initiator wire, and being constructed to activate the inflator means in response to the interruption of the electrical continuity of said initiator wire.

* * * * *